United States Patent [19]

Lee et al.

[11] 4,204,779

[45] May 27, 1980

[54] HIGH CHARACTER CAPACITY IMPACT PRINTER

[75] Inventors: Sen L. Lee, Hayward; Franklin B. Shah, Fremont; John W. Jamieson, San Leandro, all of Calif.

[73] Assignee: Qume Corporation, San Jose, Calif.

[21] Appl. No.: 894,540

[22] Filed: Apr. 7, 1978

[51] Int. Cl.[2] ..... B41J 1/30; B41J 3/54

[52] U.S. Cl. ..... 400/144.2; 400/82; 400/149; 400/585

[58] Field of Search ..... 400/29, 82, 144.2–144.4, 400/149, 150, 151, 151.1, 171, 585

[56] References Cited

U.S. PATENT DOCUMENTS

| | | | |
|---|---|---|---|
| 3,620,344 | 11/1971 | Clancy et al. | 400/149 X |
| 3,675,753 | 7/1972 | Perucca | 400/149 |
| 3,805,938 | 4/1974 | Pearson | 400/29 |
| 3,825,681 | 7/1974 | Cederberg et al. | 400/82 X |
| 3,892,303 | 7/1975 | Willcox | 400/151 X |
| 3,966,037 | 6/1976 | Zambolin | 400/585 |
| 4,026,403 | 5/1977 | Inose et al. | 400/144.2 X |
| 4,030,590 | 6/1977 | Wojdyla | 400/82 |
| 4,044,880 | 8/1977 | Martin | 400/82 X |

FOREIGN PATENT DOCUMENTS

| | | | |
|---|---|---|---|
| 1949795 | 4/1971 | Fed. Rep. of Germany | 400/150 |

OTHER PUBLICATIONS

"High Speed Printer," IBM Tech. Disc. Bulletin, Pawletko et al., vol. 19, No. 9, Feb. 1977, pp. 3355–3356.

*Primary Examiner*—Paul T. Sewell

*Attorney, Agent, or Firm*—Richard P. Berg

[57] ABSTRACT

An impact printer of the daisywheel type mechanically links together two daisywheel printer carriages so that the total number of different characters that can be printed is doubled. Suitable coordination logic provides for operation in a first concurrent (or parallel) mode where the user's software looks ahead to provide for continuous printing along a single line. The other mode of operation is sequential where the twin print heads are substantially transparent to the user's system and thus the appropriate print head automatically positions itself to a printing position.

12 Claims, 17 Drawing Figures

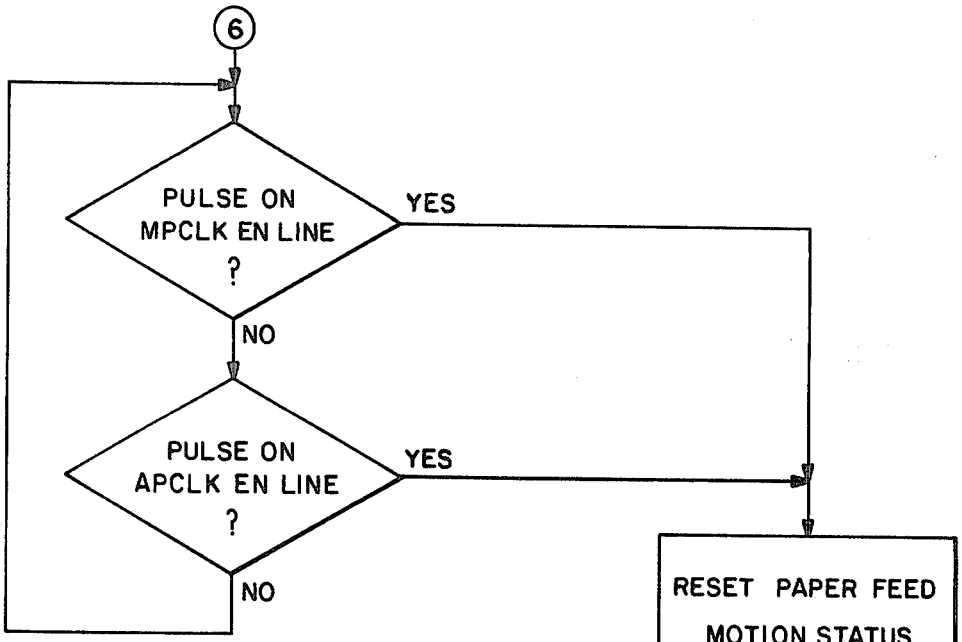
FIG.—3D
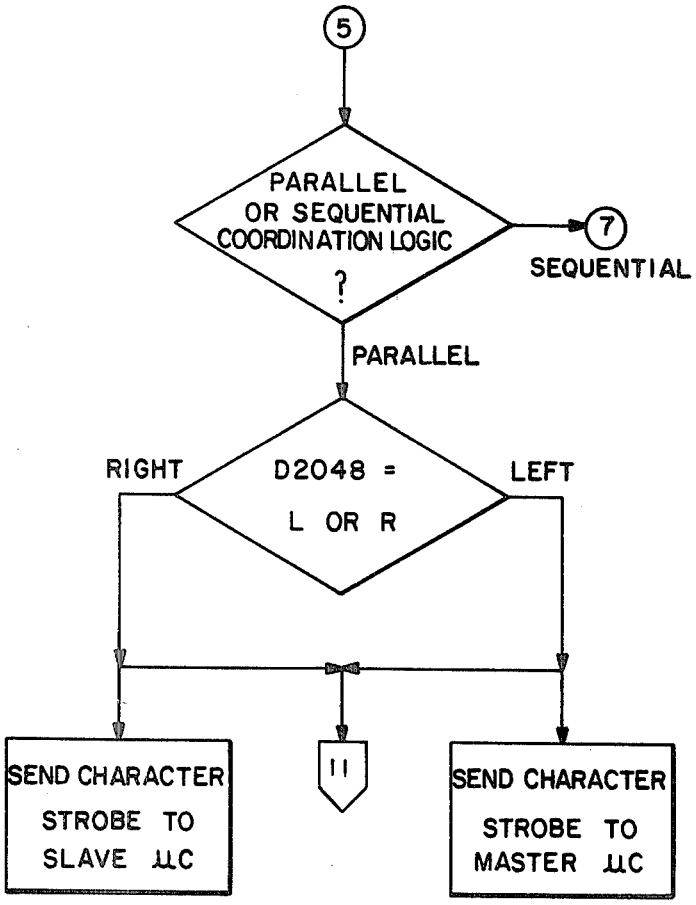
FIG.—3E
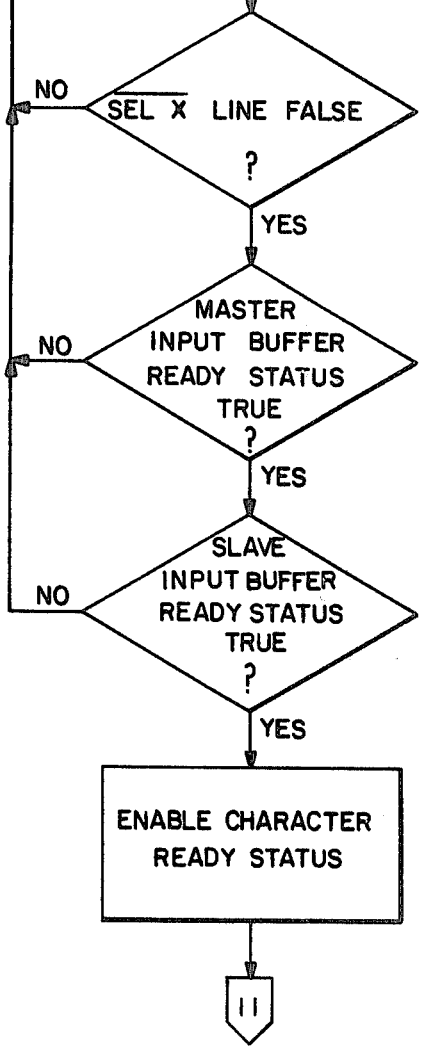

FIG.—3F
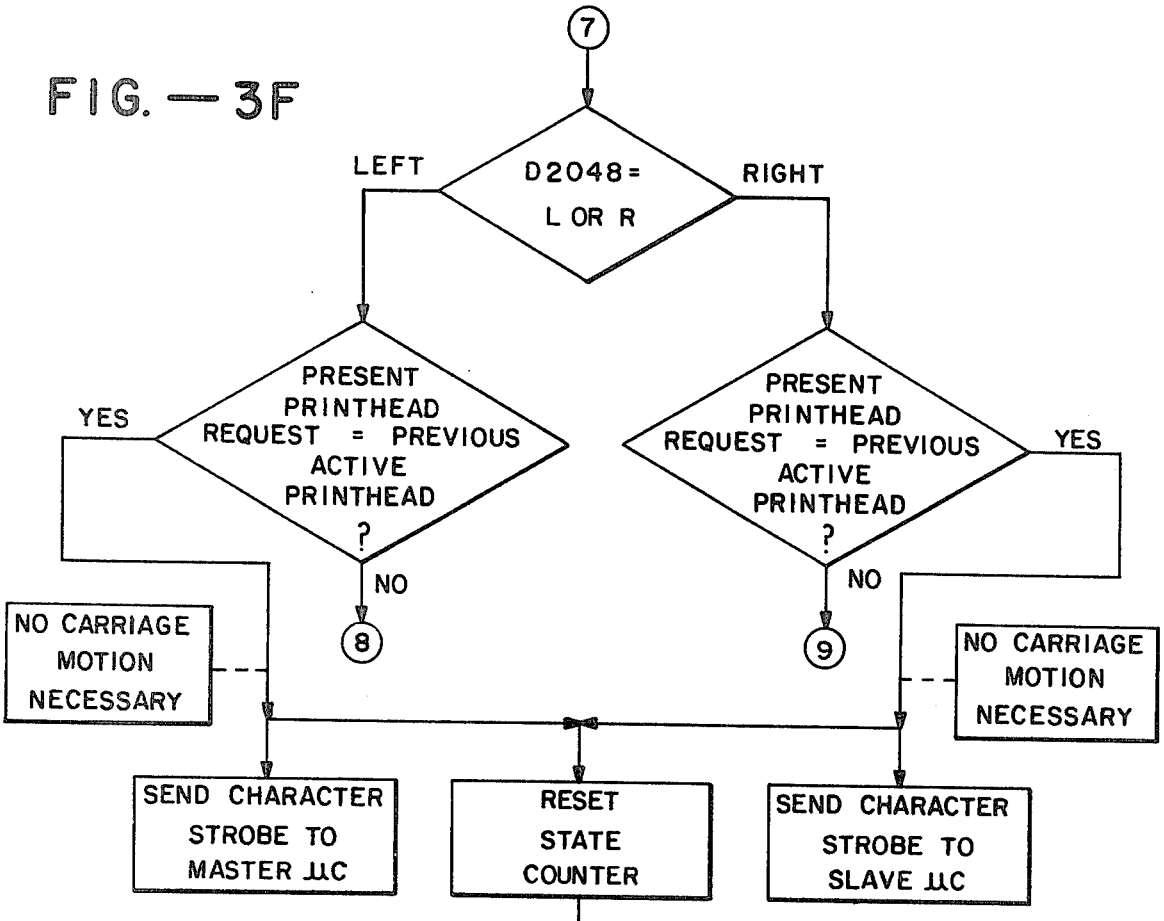
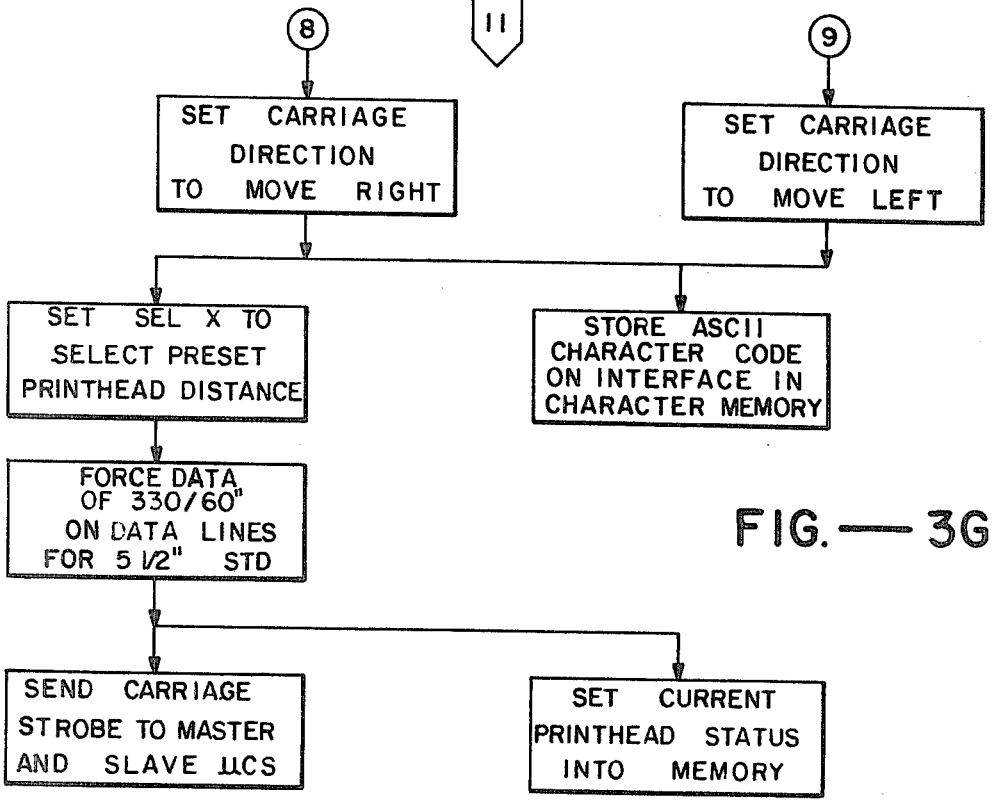
FIG.—3G

HIGH CHARACTER CAPACITY IMPACT PRINTER

BACKGROUND OF THE INVENTION

The present invention is directed to a high character capacity impact printer and more specifically to a impact printer of the daisywheel type.

In a daisywheel type character printer the daisywheel has, of course, size and weight limitations in order to minimize its mass and, therefore, increase printing speed. Print wheels typically have 96 spokes meaning the capability of printing 96 different characters.

Today, for many character printing applications, the traditional 96 on line characters is not enough. For example, character wheel changes must be made to provide bold face type or unusual custom graphics. Special character fonts are necessary, for example, in different fields such as physics, mathematics, insurance, engineering, etc. In addition, printing of a foreign language or more importantly the printing of English with foreign languages requires additional characters for these non-English letters.

Thus far in a character printer, especially of the daisywheel type, in order to provide the foregoing capability the user of the printer had to physically remove one print wheel and substitute another. This was time consuming and more importantly, is susceptible to misregistration. Moreover, the automatic capability of the printers are effectively nullified.

OBJECTS AND SUMMARY OF THE INVENTION

It is, therefore, an object of the present invention to provide an improved high character capacity impact printer.

It is a more specific object of the invention to provide an impact printer which has enhenced character capability.

It is yet another object of the invention to provide a printer as above which is easily interfaced with the existing printing logic of the user.

In accordance with the above objects there is provided an impact printer for printing characters serially on a record medium. A plurality of print wheels are rotatably mounted on a plurality of carriages which in turn are linearly movable along a common predetermined path to place the print wheels in printing positions along the path.

BRIEF DESCRIPTION OF THE DRAWINGS

FIGS. 3A through 3H are logic flow charts useful in understanding the invention;

DETAILED DESCRIPTION OF THE PREFERRED EMBODIMENTS

Figure 1:
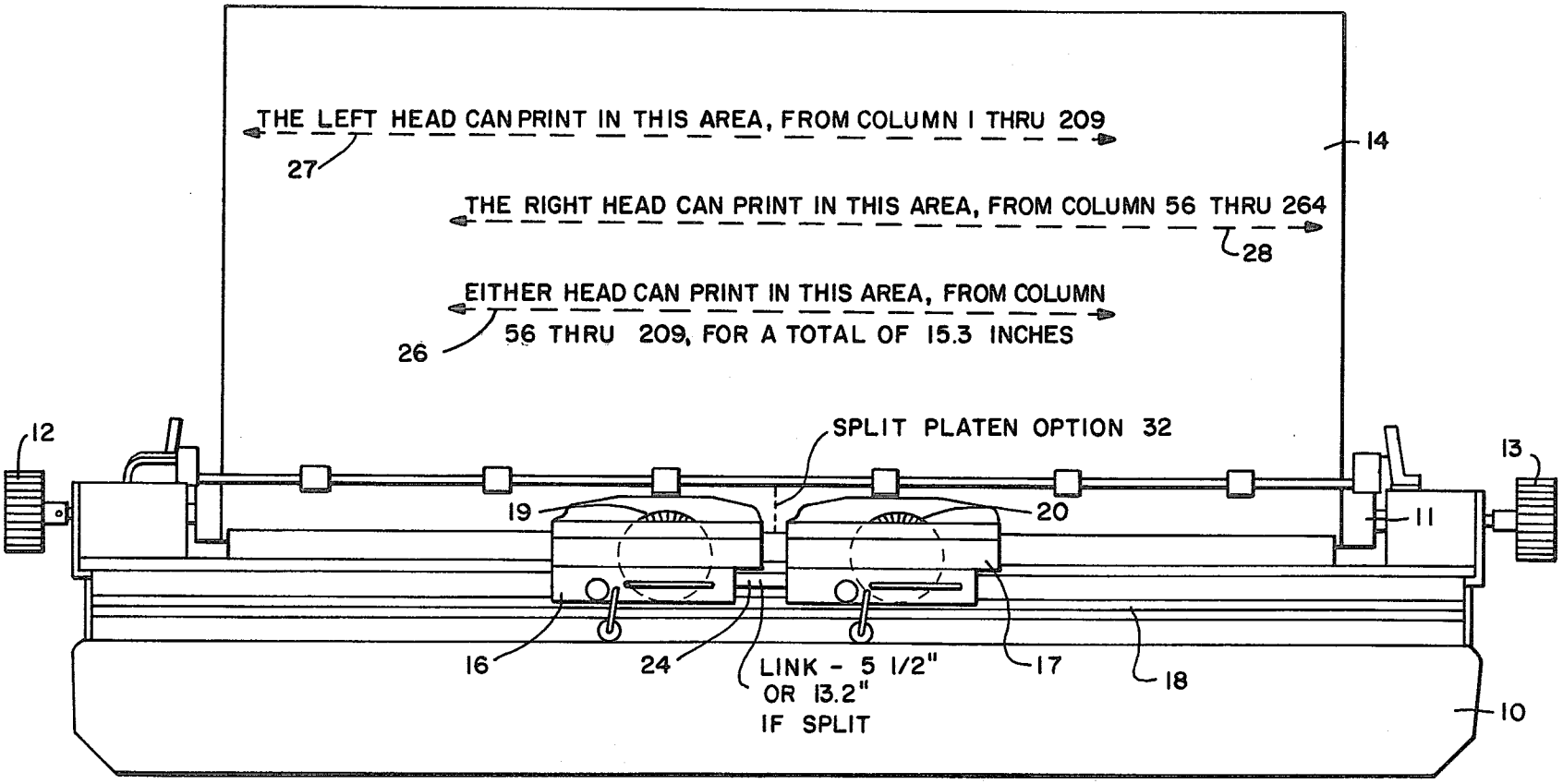
FIG. 1 is an elevation view of a printer embodying the present invention.

Referring now to FIG. 1 an overall view of the printer is illustrated. Mounted on a base 10 is a platen 11 with knobs 12 and 13 for rolling the platen 11 and the paper 14 wrapped thereon. Of course, in normal use the platen would be rotated by the paper feed servo system which will be discussed below. In accordance with the invention a pair of carriages 16, 17 are mounted for linear movement along guide rods, one of which is shown at 18. Such movement, of course, is along one predetermined common path where associated print wheels carrying printing characters will print. Carriages 16 and 17 include rotary daisy type print wheels 19 and 20, respectively. Movement of both the print wheels and the carriages are provided by servo systems which are disclosed in one form in greater detail in a copending application, Ser. No. 700,654, filed June 28, 1976, now U.S. Pat. No. 4,118,129 entitled "Rotary Wheel Printing System" and assigned to the present assignee. In addition, a paper feed motor which, for example, may be an open loop controlled stepping motor, is also provided as shown in the above application.

Figure 2:
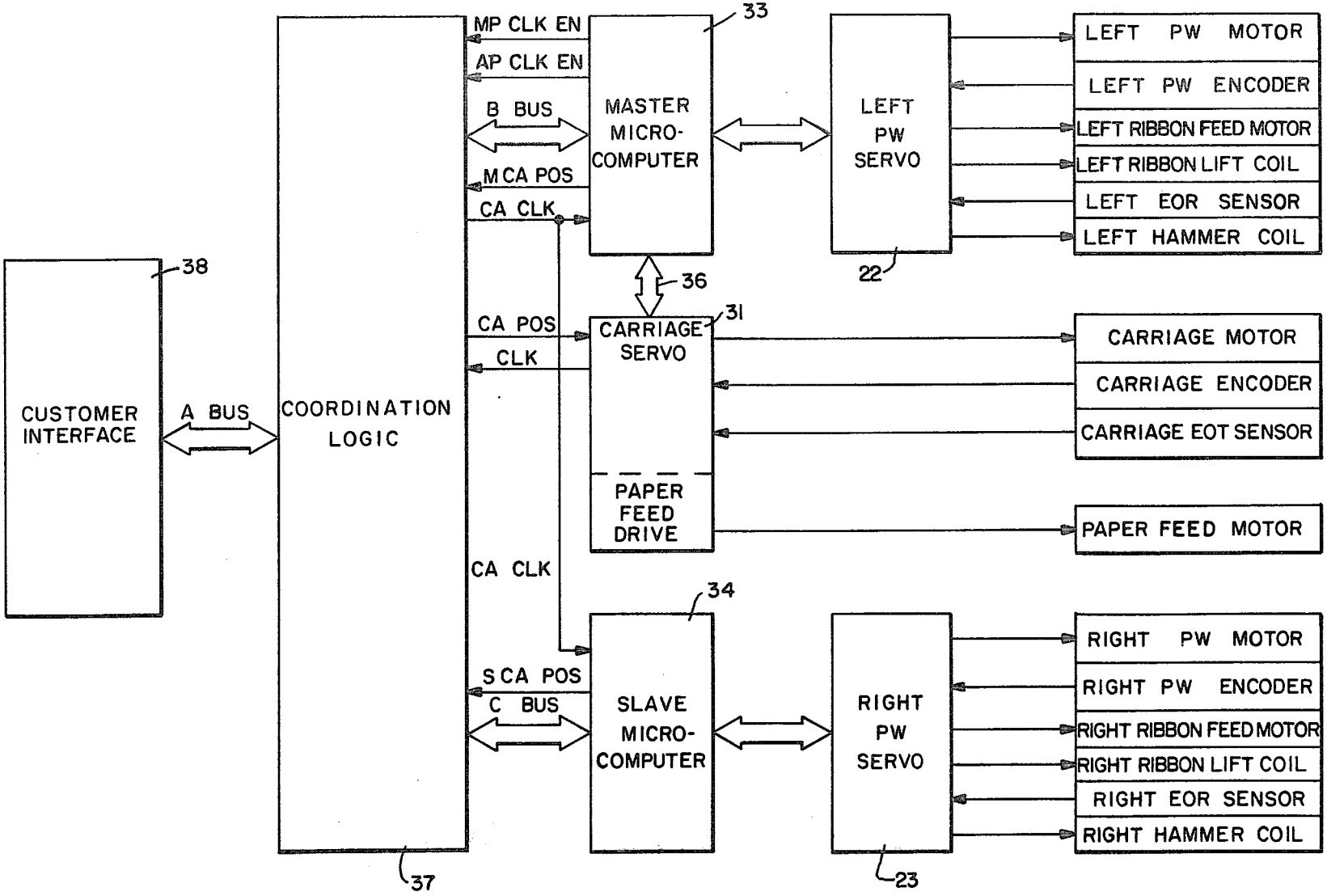
FIG. 2 is a block diagram of the control circuit used with the printer.

FIG. 2 is a block diagram of the overall system where the separate carriages or print heads 16 and 17 in effect have duplicate control systems which by themselves are well-known in the art as illustrated by the above copending application and also in another form by U.S. Pat. No. 3,954,163 assigned to Xerox Corporation.

Specifically and referring to FIG. 2, each print wheel (PW) which shall hereinafter be referred to as a left and right PW includes its servo system components 22, 23 which control the rotation of the print wheel, ribbon feed and print hammer.

In normal use the print heads or carriages 16 and 17 are linked together by a rigid metal shaft 24 (FIG. 1) which spaces the printing positions of the two print heads exactly 55 printing columns apart; therefore, for example, with a pitch of 10 characters per inch this is a distance of 5½ inches. This distance has been chosen to place the print heads as close together as possible in order to achieve the maximum common area of printing indicated by the dashed line 26 which extends from printing columns 56 through 209. Upon examination, it is apparent that the left print head as indicated by dashed line 27 can print from column one through 209 and the right head as indicated by the dashed line 28 can print from columns 56 through 264.

Referring again to FIG. 2 in normal operation the movement of the permanently linked print heads or carriages 16 and 17 and the paper feed which is a rotation of platen 11, are controlled by a common logic unit 31 which includes a carriage servo and paper feed drive. However, as an alternative embodiment as indicated by the dashed line 32 of FIG. 1 on the platen 11, indicating "split platen option" separate sheets of paper, for example, in an accounting environment may be used with the left and right print heads printing on both sheets at the same time. Thus the platen 11 would have two paper feed motors. Thus each platen half can be controlled separately or they can be rotated simultaneously. Moreover, the left and right print heads could be separated a greater distance of 132 columns or 13.1 inches at a 10 pitch so that with the left print head at the left printing column of the left hand platen sheet the right print head would be at the left hand printing column of the right platen sheet.

The left and right platen portions need not be of equal length. And moreover they can selectively be of the friction, tractor, and pinfeed types.

Referring again to FIG. 2, the left and right print heads' control functions are respectively controlled by a master microcomputer 33 and a slave microcomputer 34. Master microcomputer 33 in general has exclusive control of the carriage servo and paper feed drive 31 as indicated by the data link 36. As thus far described (and except for mechanical link 24) the system of FIG. 2 is in essence two separate daisywheel character printing systems which are complete in themselves and are well-known in the art as exemplified by the above cited patents.

However, in accordance with the invention in order to coordinate the operation of the two printing systems and to achieve the several advantages of the present invention the coordination logic shown in block 37 is necessary. Such coordination logic on an "A" bus is connected to a customer interface which has typical ASCII type data and control instructions. A "B" bus links the master microcomputer 33 with the coordination logic and a "C" bus links the slave microcomputer 34. As is apparent from the use of the terms "master" and "slave" the master system with its control of carriage and paper feed movement is dominant over the slave system.

Other control lines indicated between the coordination logic and the various blocks are a carriage clock (CA CLK) which provides for step type incremental movement of the twin carriages. Master and slave carriage position indications designated MCAPOS and SCAPOS, respectively, are signals to the coordination logic indicating that the master and slave microcomputers are ready for carriage motion. The resulting CAPOS signal from the coordination logic allows the carriage servo to move. A pair of lines designated MPCLK EN and APCLK EN are signals from the master microcomputer to the coordination logic indicating that the main paper feed motor of (in the case of a split platen) auxiliary or slave paper feed motor are in the process of completing motion. All of the control lines will be discussed in detail in the associated circuit block diagrams and flow charts.

Figure 3A:
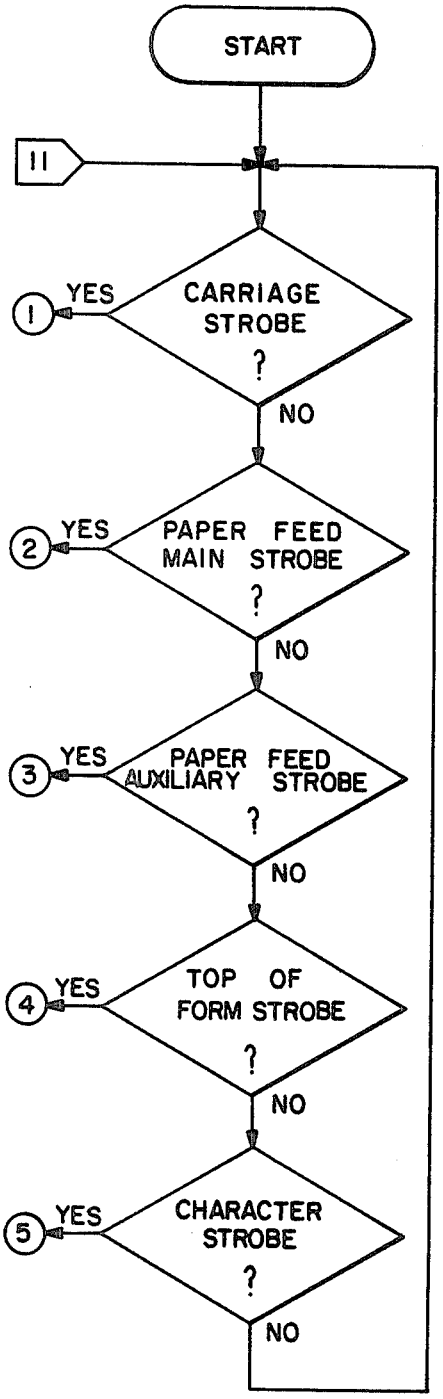

Now referring to the flow chart consisting of FIGS. 3A through 3H, the flow chart explains the operation of the coordination logic 37 shown in FIG. 2. FIG. 3A illustrates the start and idle mode where customer ASCII type data and control information on the A bus is continuously sampled as indicated in the flow chart asking a series of questions; for example is it a "carriage strobe" meaning that the customer wishes a carriage movement, is it a "paper feed main strobe", an "auxiliary paper feed strobe" (used in the split platen situation) a "top of form strobe" or a "character strobe". Once an actual ASCII signal is sensed then one of the five different numbered points is branched to.

Figure 3B:
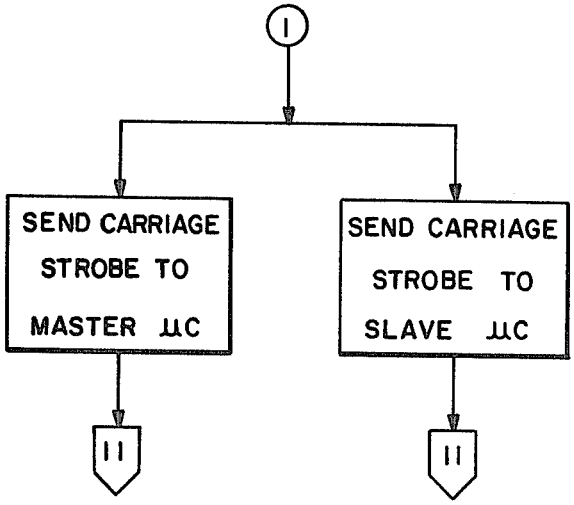

For example, if the carriage strobe is received, the branch is to FIG. 3B which is point 1 and the carriage command is steered by the coordination logic to both the master microcomputer and slave microcomputer. This will eventually cause the movement of the carriage to where the customer system has dictated it is to print and then branches to point 11 of FIG. 3A and the scanning continues looking for the next command.

Figure 3C:
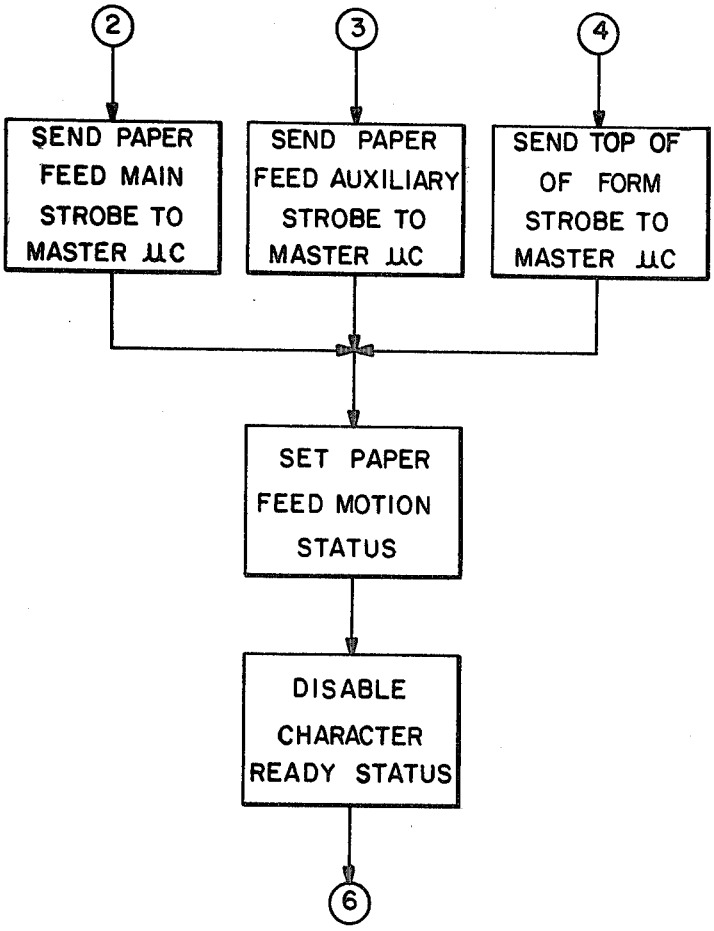

Continuing with the flow chart of FIG. 3A, if a paper feed main strobe is received, then the branch is made to point 2 as illustrated in FIG. 3C. In this particular case the paper feed command only goes to the master microcomputer since as discussed above it has full control over the paper feed motion. Hence the master microcomputer acts on the paper feed command setting the paper feed motion status to be true, disables the character ready status and branches to point 6 shown in FIG. 3D. Here it is determined by the examination of the PCLK EN lines whether or not paper feed motion is complete. If it has been completed, then the logic "Yes" resets the paper feed motion status. Prior to determining this particular path back to point 11 of FIG. 3A, several more questions are asked including: (1) is a select X line false (which is only used in the sequential mode; in the parallel mode the answer to this question will always be yes) and, (2) are the master and slave input buffer ready status true meaning that both the master and slave microcomputers are ready to receive the next input. Such ready status is a well-known control indication in printers of this type. If both of these answers are "Yes", then the character ready is enabled again and the beginning of the loop in FIG. 3A is gone back to.

The same loops occur as shown in FIG. 3B for the paper feed auxiliary strobe and the top of form strobe of FIG. 3A. Top of form, of course, is normally used to move the platen to the first printing row to the next form. Auxiliary paper feed is for a split platen. Thus far there is very little coordination difficulty since as discussed above the left print wheel system (the master system) exercises supervisory control over both the carriage and paper feed movements.

However, the character strobe which branches to point 5 of FIG. 3E is a complicated case and takes different paths depending on whether the parallel (concurrent) mode or sequential mode of operation is being used.

The parallel of concurrent mode is the simplest and in the logic illustrated in FIG. 3E the most significant bit (D2048) of the character data is sensed and if it is, for example, true or a 1 then it indicates a character is to be printed by the right print wheel and if it is false or a 0, a character is to be printed by the left print wheel. The character strobe is thus sent to either the master of slave microcomputer. Then point 11 is gone back to.

The foregoing is therefore the sum total of the parallel mode of operation. It is apparent that with this mode of operation while the internal logic of the printer is relatively simple the customer or user must extensively modify their software program. In other words, the software (or the hardware as provided by the capability of the special interface unit) must be aware of the characters that can be printed by both print stations without moving the carriage. This involves a "look ahead" to determine if the character that will be printed at the position occupied by the second print station will be from the second print wheel. If it is, it should be printed, while the first station is printing at the other location. Since the distance between the two print stations is a fixed 5.5 inches, the arithmetic for the "look ahead" is relatively simple. It requires that somewhere in the hardware or software there is a line buffer. It is usually practical to use the customer's computer memory, accessing different memory locations to achieve the "look ahead" without actually moving or copying the data. When the characters are placed into the buffer the most significant eighth bit is attached to each character to designate printing by the right or left print wheel.

Other techniques can be devised to do the same to implement this parallel or concurrent mode. For example, on large, sophisticated processors, the raw text could be tested as it reaches the interface of the customer and left and right print wheel decisions made at that time. All possible printing would be done by the leading print wheel, and those characters that required the trailing print wheel would be "saved" and printed when that print wheel reached the proper position.

On the other hand, as will now be discussed in detail below, in the case of the sequential mode of operation all that need be done by the customer is the modification of the most significant bit of the character data that indicates left or right print wheel. Other than that, the capability of the present invention is transparent to the user. The parallel mode is, of course, the fastest reaching average speeds of 75 characters per second. The sequential mode time is consumed by the tabbing of the 5½ inch distance by one print head or the other.

Referring to the flow chart of FIG. 3E, if sequential coordination logic is utilized, a branch is made to point 7 in FIG. 3F. There the question is asked if the most significant D2048 bit indicates a printing operation for the left print head or the right print head. Both succeeding logic blocks ask whether the present print head request is the same as the previous active print head. If the answer is yes, which means that for example the left print head is already in position, then the carriage does not have to be moved to print the next character and hence the character strobe as indicated in the next block is merely sent to the master microcomputer, the state counter is reset and the branch is made back to the beginning (FIG. 3A). The same occurs if this condition occurs for the right print wheel. Here the character strobe is sent directly to the slave microcomputer which then prints the character and resets the state counter.

Now, for example, if printing had occurred on the left hand and the answer to the present mode of printing requires the right head and vice versa then a branch must be made to the point 8 or point 9. This is illustrated in FIG. 3G, and for example, referring to the point 8 branch, the carriage direction must be set to move right. This is because the previous active print head was by definition the right print head and now that it is desired to print with the left print head the carriage must, of course, be moved to the right to move into the subsequent printing column.

It should be noted at this time that since the entire logic sequence was started by the sensing of a character strobe on the data lines and this character data is not to be executed immediately because of the need to command the carriage to move first, therefore, the character data must be stored in temporary character memory which is here indicated. At the same time, there is a select X command to select the preset print head distance (in our case 5½ inches) which the carriage must move. This distance is stored in a memory to be discussed below in conjunction with the logic block diagrams. Also different distances can, of course, be chosen depending on the application; for example, in a split platen situation it might be 13.1 inches.

Next this preset distance is forced on the data lines. Since increments of 1/60 of an inch are used the 5½ inch distance would require 330 incremental moves by the carriage servo. With this data on the data lines, the carriage strobe is indicated and in the next block is sent to both the master and slave microcomputers so that together they will coordinate the motion of the left and right hand print heads.

In the case of the opposite where the last active print head was the left one and it was desired to now use the right print head, then the flow chart falls through on point 9 where carriage direction is set to move left and the same steps occur thereafter.

After each of these character print operations it is desired to remember which head was active last because of the obvious logic set out above, so therefore concurrently with the carriage strobe there is set into memory the current print head status.

Figure 3H:
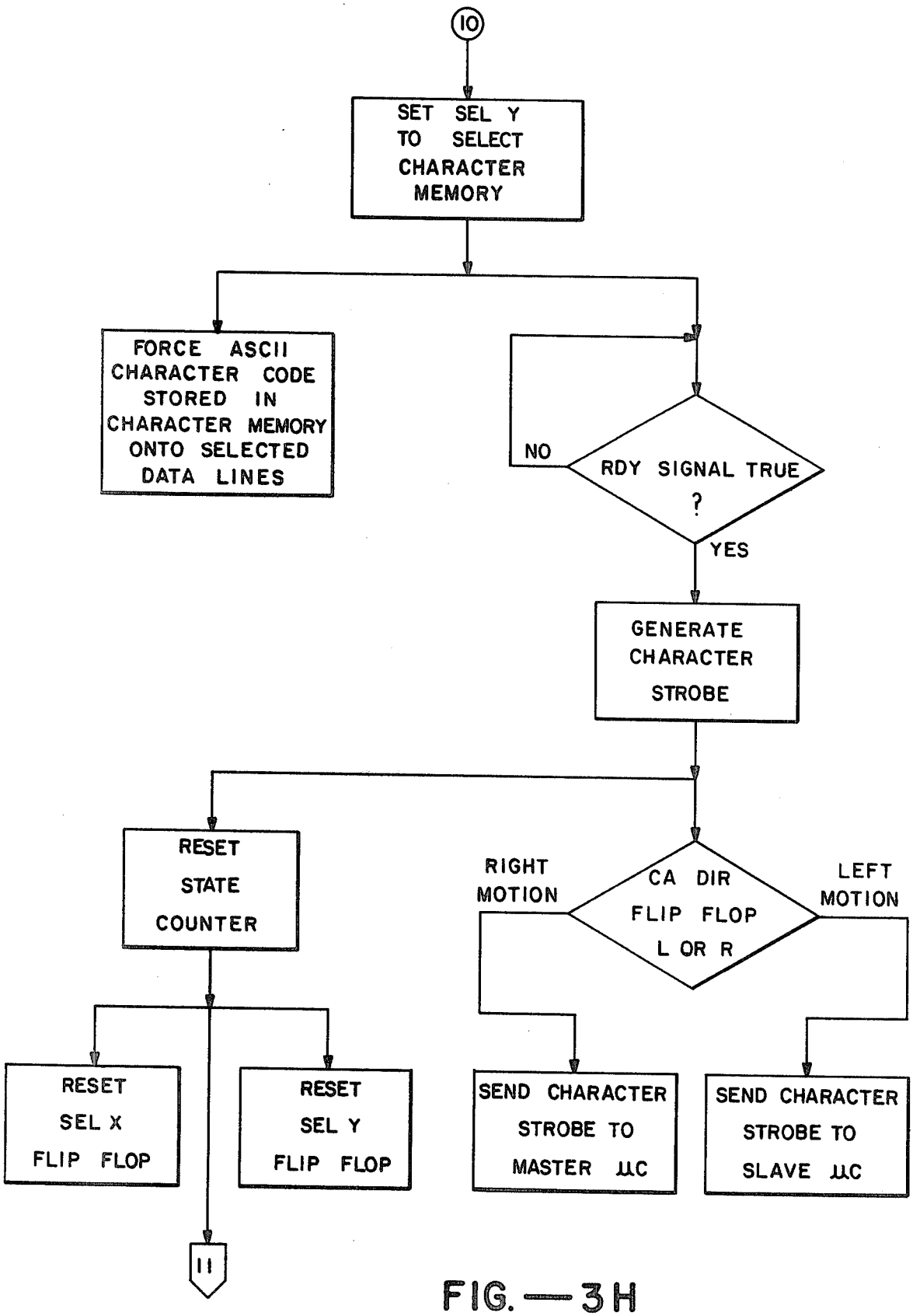

Now that the carriage is in the proper position, the character that is in the character memory can be printed. This is point 10 and is branched to as illustrated in FIG. 3H. Here a select Y line (which is shown in the logic block diagram) selects the data in the character memory. The ASCII code that is stored in the character memory is forced upon the selected data lines. At the same time the printer is looked to to determine if it is ready (RDY) to accept the particular command. If not, a waiting or idle loop is created until the printer is ready to accept that command at which time the character strobe is generated. Such character strobe, shown by the next block, is sent either to the master microcomputer or slave microcomputer depending on which direction the carriage direction logic or flip-flop which was related to the carriage direction of FIG. 3G was previously set. The character is then strobed and printed. At the same time a state counter is reset along with select X and Y associated flip-flops and the initial starting position is returned to. This thus completes the sequential mode of operation.

The hardware or software as the case may be to accomplish the logic flow chart of FIG. 3 is illustrated in FIGS. 4A through 4D. The blocks in the diagram with an asterisk indicate that this block is needed only for the sequential mode of operation and is not necessary for the concurrent or parallel mode.

Figure 4A:
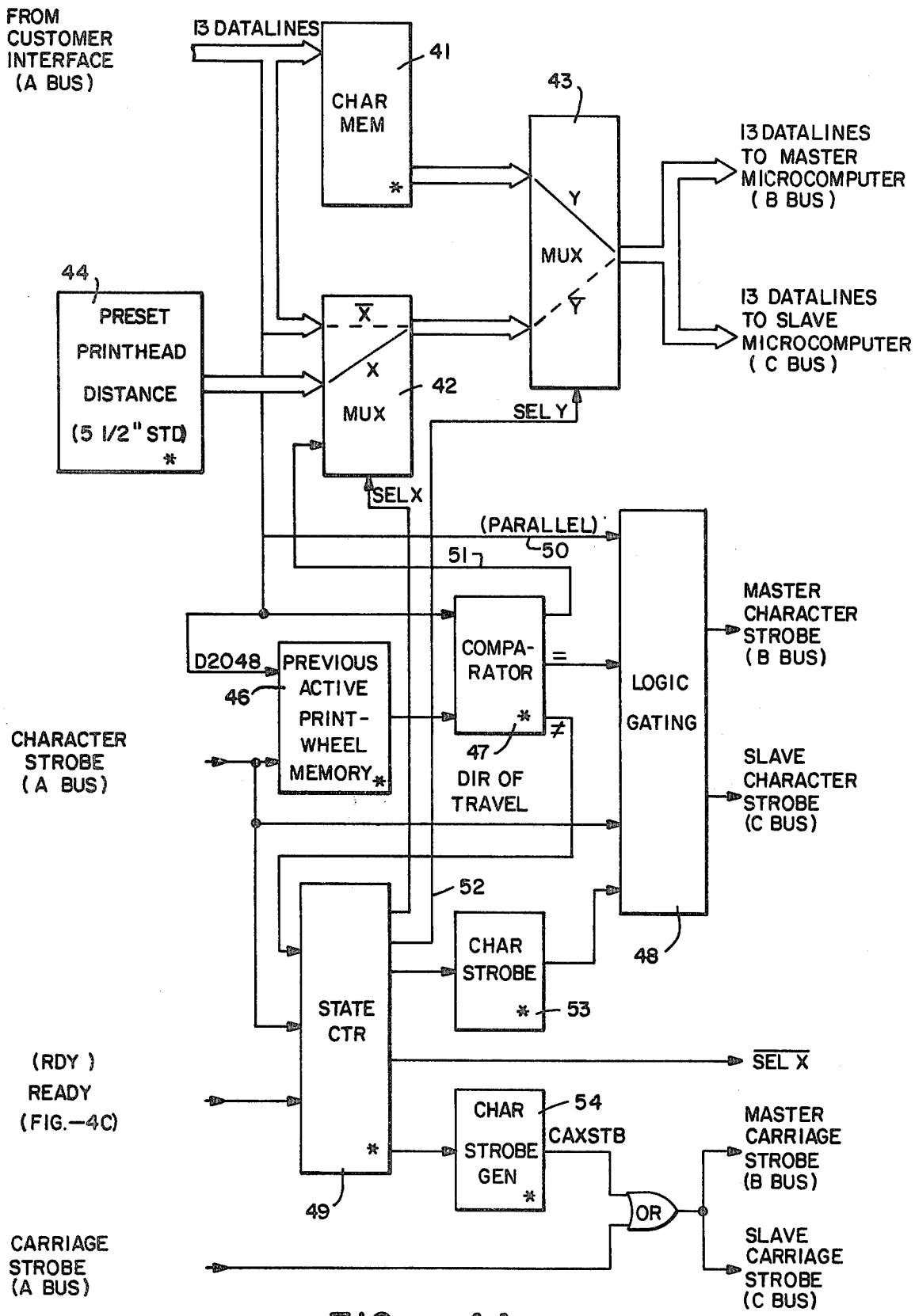
FIGS. 4A through 4D are hardware implementations of portions of the flow charts of FIG. 3.

Referring now to FIG. 4A the A bus from the customer interface on its 13 standard data lines extends both to a character memory 41 and a multiplexer unit 42. The character memory is for temporarily storing a character command when the incorrect print wheel is in the printing position. See FIGS. 3G and 3H. Multiplexer 42 in conjunction with a multiplexer 43 are related to the select X and select Y commands in establishing one of three possible data paths to the master microcomputer or the slave microcomputer. These are (1) from the customer interface, (2) from the character memory 41 or (3) from the preset print head distance unit 44 which stores the 5½ inch standard distance (see FIG. 3G). The paths are indicated in the multiplexers for select X and select Y being true and with a solid connection and false with the dashed connection. Thus as illustrated by the flow chart of FIG. 3G to force the preset print head distance from block 44 on the data lines of the printers select X is true and select Y is false.

Block 46 designated "previous active print head memory" receives the most significant data bit, D2048. This is discussed in FIG. 3G where the current print head status is set into memory. The purpose of this is to decide whether the present command uses the same print wheel or not. This is determined in comparator unit 47 which compares the present command with the previous active print wheel status to determine if it is necessary to move the carriage. Hence a direction of travel bit is generated if a nonequal comparison occurs. However, if it is equal, then as illustrated in FIG. 3F a very simple situation occurs where the character strobe that did come through is steered by logic gating 48 to the master microcomputer or slave microcomputer depending on which head it is desired to do the printing at the time. Thus the equal indication from comparator 47 extends directly to logic gate 48 which then steers the strobe to the proper master or slave bus (B bus or C bus). Similarly, for the parallel mode there is a direction connection of the D2048 bit via line 50 to gating 48 to accomplish the logic of FIG. 3E.

If not equal, then a state counter 49 is activated which executes the flow chart as illustrated in FIG. 3G. In addition, comparator 47 also has a line 51 connected to the multiplexer 42 to set select X to connect the preset printer distance unit memory 44 onto the data bus for both the master and slave microcomputer. In addition, multiplexer 43 already provides for connection of this carriage information to the data lines. Block 54 is a carriage movement generator activated in accordance with the flow chart of FIG. 3G where when multiplexer 42 connects the preset print head distance to the data lines a carriage strobe (CAXSTB) is generated to move or tab it to the proper position.

As also illustrated in FIG. 3H the Y select, line 52, is activated to connect the master or slave data lines to the character memory 41 in preparation for the reception of the character strobe. A ready (RDY) line is inputted to state counter 49. This ready signal is the key signal that triggers the state counter to go into the next state; that is, once the carriage has moved to the printing position a character is to be generated. This is illustrated in FIG. 3H also where a character strobe is generated. Character strobe generator 53, under control of state counter 49, generates a character strobe which by means of logic gating 48 is sent to the master or slave bus.

Figure 4B:
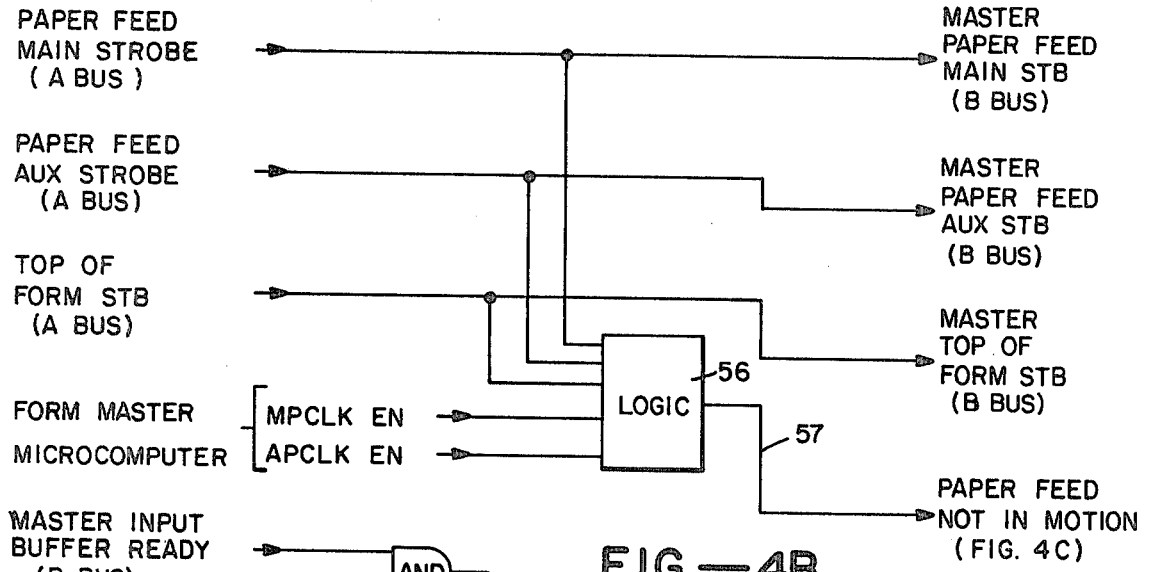
Figure 4C:
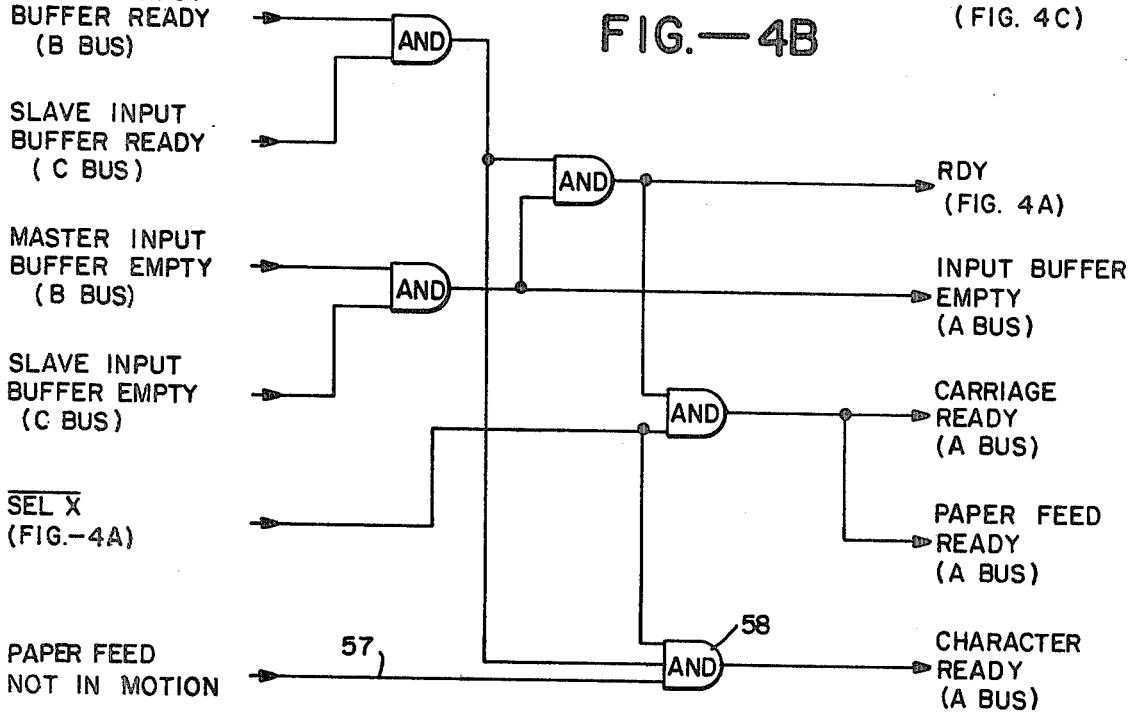

The next group of control lines illustrated in FIG. 4B all relate to the paper feed motions and can easily be correlated with the flow chart of FIG. 3C. Here there is the main paper feed, the auxiliary paper feed (in the case of a split platen) and top of form which are all sent to the master microcomputer which has overall control of the system of the present invention. Any of these paper feed commands will cause the paper feed not in motion status from the logic unit 56 to be false (assuming negative logic). This paper feed in motion signal on line 57 is utilized in determining, in conjunction with FIG. 4C, whether the ready lines are true or not. Specifically referring to FIG. 4C such ready lines are the ready (RDY) indication used in conjunction with the state counter 49 of FIG. 4A and other ready indications including character ready. If there is paper motion, the character ready status will, of course, always be false due to the paper feed not in motion line 57. The associated AND gate 58 also depends on the coincidence inputs that the select X mode is not being used and that both master and slave input buffers are ready and that they are also completely empty. This is, of course, the RDY indication also.

In general before commands can be given to the printer by the customer the input buffer must be ready and the associated ready (viz, carriage, paper feed and character) must be tested before that command can be strobed in.

Figure 4D:
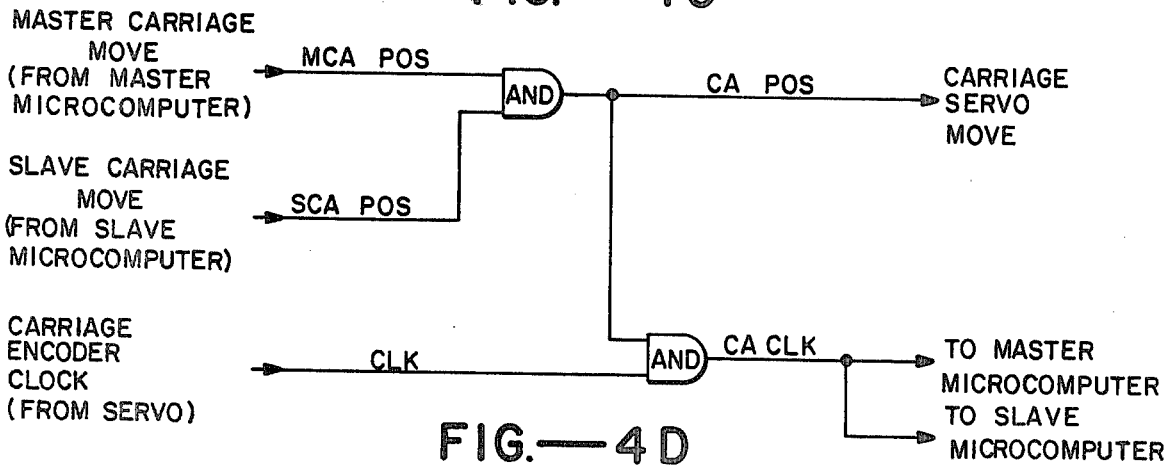

Lastly, FIG. 4D relates to the coordination of the carriage movements in the servo and microcomputers as illustrated in FIG. 2. For example, the commands from the master and slave microcomputer to move are ANDed and thus both must coincide before the carriage moves. This assures that the two microcomputers operate in synchronism with each other. The foregoing coordination also provides for the fast that one printer may be finishing the printing of a character while the other print head and its associated microcomputer is theoretically idle and therefore ready for carriage movement.

Figure 5:
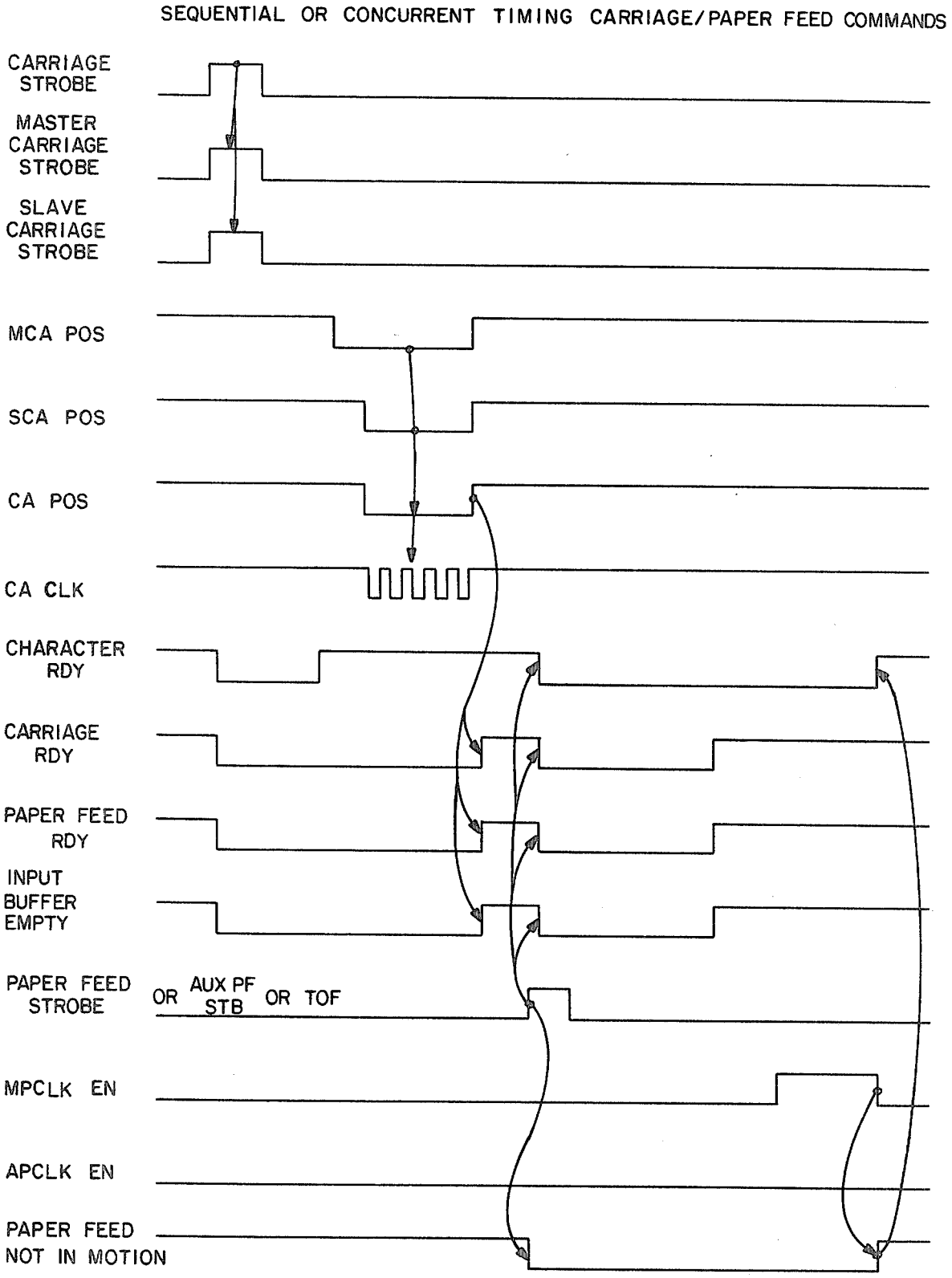
FIGS. 5, 6 and 7 are timing diagrams useful in understanding the operation of the invention.
Figure 7:
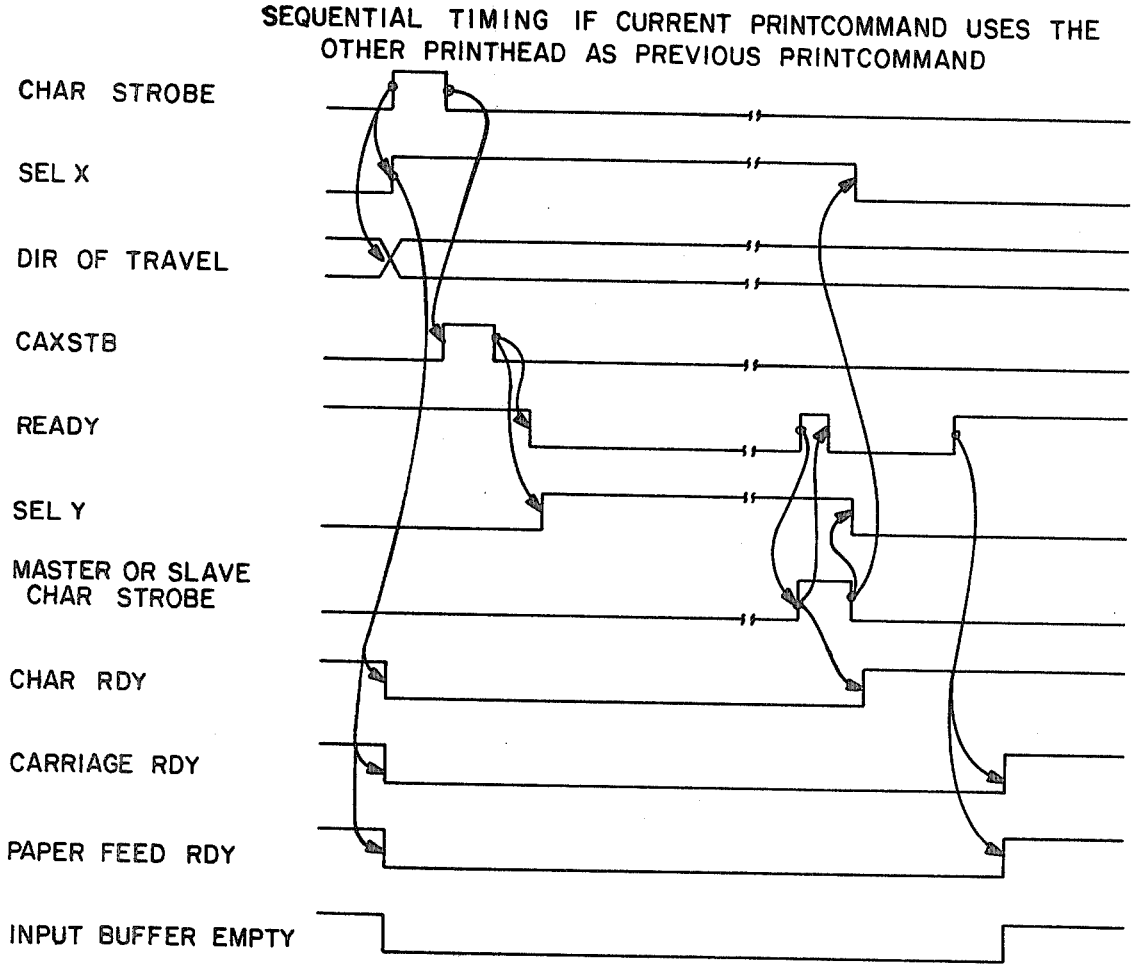
Figure 6:
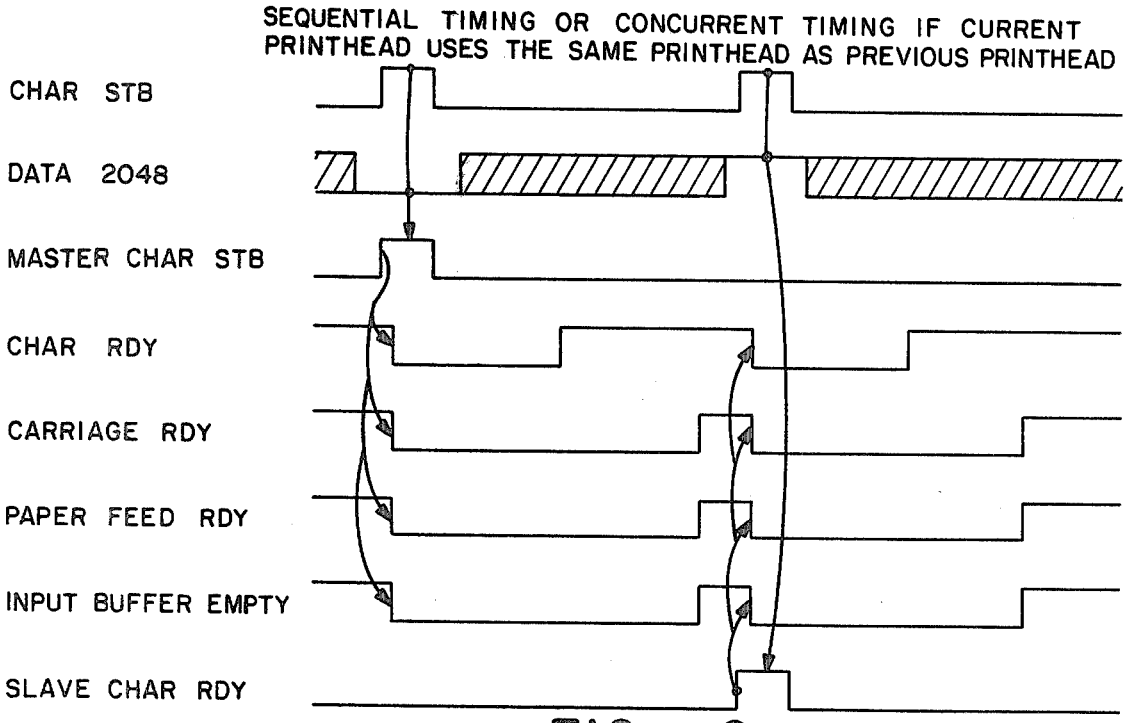

The flow charts and logic block diagrams can both be understood by reference to the timing diagrams of the FIGS. 5, 6 and 7. In the case of FIG. 5 this relates to the carriage paper feed commands which are the same both for sequential or concurrent timing. The designations on the different timing diagrams are also found in FIGS. 4B, C and D. FIG. 6 illustrates the case of sequential or concurrent timing if the current print command uses the same print head as the previous command. This is obvious from inspection of the flow chart of FIG. 3E for parallel or concurrent timing and FIG. 3F for the sequential mode. Note the two cases of the 2048 data bit where if it is low a printing occurs on the master print wheel and if high on the slave print wheel. The ready conditions of character ready, carriage ready, paper feed ready and input buffer empty are, of course, shown in FIG. 4C.

Lastly, the sequential timing mode only is shown in FIG. 7 where the current print command uses the other print head as the previous print command which the flow charts of FIG. 3G and 3H are illustrated. Here a select X and select Y command must be given to displace or jump the carriage the preset distance.

Thus a character printer with enhanced character capability has been provided. Although only two print heads have been illustrated three or more could be used. With respect to the most significant bit of character data controlling print head selection a more complex code could be utilized, especially with more than two print heads.

Many additional benefits arise from the character capability of two or more print wheels. For example print wheels with substantially identical character fonts can be used to print text, tabular, or columnized material with much greater speed and efficiency than a single-head printer. On the other hand each print wheel can contribute a part or building block of an overall printed construction. This may be used for printing complex arabic or oriental characters or in plotting topographical contour maps. Many similar applications will become apparent.

What is claimed is:

1. An impact printer responsive to character commands for printing characters serially on a record medium comprising: a plurality of print wheels each having a mechanically limited number of characters and each having at least some unique characters relative to the other print wheel or wheels; a plurality of carriages, with said print wheels rotatably mounted thereon respectively, linearly movable along a common predetermined path to place said print wheels in printing positions along said path, and mechanically linked together to maintain a predetermined spacing therebetween throughout said linear movement; logic means responsive to said character commands for coordinating the printing wheels in a common area of said record medium, said logic means generating a carriage move command equal to the spacing between print wheels in response to the character command previous to the present character command occurring on another print wheel to bring the other print wheel to a printing position.

2. A printer as in claim 1 where said printer is responsive to a standard character command input data, a predetermined code of such data designating one of said print wheels, said logic means being responsive to such code for selecting a print wheel.

3. A printer as in claim 2 where such code is the most significant bit of character input data.

4. A printer as in claim 1 where said printer includes a platen having two separately movable portions.

5. A printer as in claim 1 where two of said print wheels include symbols which form portions of complete printed constructions.

6. A printer as in claim 5 where said symbols form a contour map construction.

7. A printer as in claim 5 where at least some of said symbols consist of a character portion.

8. A printer as in claim 1 where said logic means associates paper feed and carriage movement commands with a predetermined master print wheel, the other print wheel or wheels being slaved.

9. A printer as in claim 1 where said printer is responsive to ASCII type input data and where a predetermined code of such data designates which of said print wheels is to be commanded.

10. A printer as in claim 9 where such code is the most significant bit of character input data.

11. A printer as in claim 1 where said logic means includes memory means for storing said present character command for a time period to allow said carriage to move a distance equal to the spacing between print wheels.

12. An impact printer responsive to character commands for printing characters serially on a record medium comprising: a plurality of print wheels each having a mechanically limited number of characters and each having at least some unique characters relative to the other print wheel or wheels; a plurality of carriages, with said print wheels rotatably mounted thereon respectively, linearly movable along a common predetermined path to place said print wheels in printing positions along said path, and mechanically linked together to maintain a predetermined spacing therebetween throughout said linear movement; means for feeding said record medium through said printer; separate master and slave logic means with said master logic means being exclusively connected to and controlling the printing of one of said print wheels and one or more slave logic means being exclusively connected to and respectively controlling the printing of said other print wheels, said master logic means also being connected to and controlling said feeding means and controlling said carriage movement; and coordination logic means responsive to said character commands for selecting a predetermined one of said print wheels to print at the next carriage printing position.

* * * * *